US006163938A

United States Patent [19]

Weber-Unger

[11] Patent Number: 6,163,938

[45] Date of Patent: Dec. 26, 2000

[54] GARMENT FASTENER

[76] Inventor: Georg Weber-Unger, Pienzenauerstrasse 15, Kufstein, Austria, 6330

[21] Appl. No.: 09/113,185

[22] Filed: Jul. 10, 1998

[30] Foreign Application Priority Data

Jul. 10, 1997 [DE] Germany ..... 197 29 610

[51] Int. Cl.[7] ..... A44B 21/00

[52] U.S. Cl. ..... 24/303; 24/669

[58] Field of Search ..... 24/303, 702, 693, 24/697.1, 697.2, 669, 575, 579.1, 108, 114.6

[56] References Cited

U.S. PATENT DOCUMENTS 2,102,223 12/1937 Roseman .
2,809,411 10/1957 Moghadam .
3,111,737 11/1963 Heil .
3,376,616 4/1968 Kaczorowski .
3,512,226 5/1970 Carlile .
4,399,595 8/1983 Yoon et al. .
4,805,272 2/1989 Yamaguchi .
5,611,120 3/1997 Riceman et al. .
5,926,925 7/1999 Hicks .

*Primary Examiner*—James R. Brittain
*Attorney, Agent, or Firm*—Pennie & Edmonds LLP

[57] ABSTRACT

A garment fastener includes two constituent fastener components (1, 2) each of which is provided with a front disc and a back disc (3, 5; 4, 6) and a fabric section (8, 10) is sandwiched between these discs. In order to permit, to the greatest extent possible, one-handed manipulation and to cause the fastener components to center themselves automatically when in the closed state, one of the fastener components (1) is provided at its perimeter with a hooked, U-shaped projection (13) and the other, complementary fastener component (2) is provided within its perimeter with a counterhooked projection (15). In the closed state, the hook and counterhook are partly engaged. Each fastener component (1, 2) contains a magnet (11, 12) which allows the fastener components to attract each other and to mutually center themselves. A strong pull in the closing direction causes a further, more positive engagement between the hook and counterhook. When there is little pull or the straps are fully relaxed, the fastener components (1, 2) will resume their centered position.

19 Claims, 2 Drawing Sheets

GARMENT FASTENER

BACKGROUND OF THE INVENTION

This invention relates to a garment fastener, consisting of two fastener components, each of which is attached to a fabric section and is provided with a disc in front and back. Each of the said fabric sections is sandwiched between the front and back discs of the respective fastener component and the two discs of each fastener component are firmly connected with each other through a hole in the respective fabric section.

An example of a fastener based on this principle is the conventional snap button in which one fastener component is provided with a centrally positioned prong that is thicker at its free end, while the other fastener component of the snap button has a centrally positioned opening into which the prong of the first-mentioned fastener component can be snapped when the two fastener components are axially aligned with each other. Aligning the two fastener components of a snap button and pressing them together often requires the use of both hands. Axially pulling at them in opposite directions separates the fastener components of the snap button. Pulling at them in only a radial direction will not disengage the fastener components of the snap button from each other. For some clothing items it is desirable to prevent the fabric sections from separating when the fastener is pulled in one direction along the plane of the fabric while separating when the fastener is pulled in the opposite direction. At the same time, when the garment is being worn, there is almost no pull on the fabric sections in the direction perpendicular to their plane, obviating the need for the fastener to provide much strength for holding the fabric sections together in that direction. For some garment items it is desirable to be able to open and close them with one hand, a requirement a snap button cannot meet.

SUMMARY OF THE INVENTION

This invention is aimed at providing a garment fastener which holds the two fabric sections that are to be connected securely together in one direction along the plane of the said sections yet can be easily opened in the opposite direction, preferably with one hand. According to the invention, this is accomplished in that the front disc of one of the fastener components is provided at its perimeter with a hook-shaped projection while the front disc of the other fastener component is provided on the inside of its perimeter with a counterhook-shaped projection, whereby, when the fastener is closed, the counterhook engages the first hook from behind and the front discs of the two fastener components are in flush contact in essentially parallel and coaxially aligned fashion.

The fastener according to this invention is particularly suitable for connecting two textile straps which, along their plane, are subjected to considerable pull while permitting easy separation when pulled in the opposite direction. This fastener is especially useful for garments with straps which should ideally permit being hooked together with one hand, as for instance in the case of nursing bras. However, the fastener is also suitable for use on pockets, bags, suitcases and safety belts.

The advantages of the fastener according to this invention include its simple design, its low manufacturing cost, its easy manipulation and its broad spectrum of possible applications.

Desirable design enhancements of this invention are covered in the subclaims.

BRIEF DESCRIPTION OF THE DRAWINGS

Two design examples of this invention arc described below in more detail and illustrated in the drawings in which.

DETAILED DESCRIPTION OF THE PREFERRED EMBODIMENT

Figure 1:
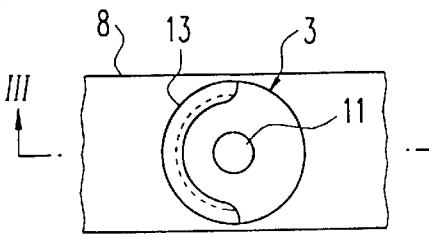
FIG. 1 is a top view of the front disc of one of the two fastener components according to a first design example of this invention.
Figure 2:
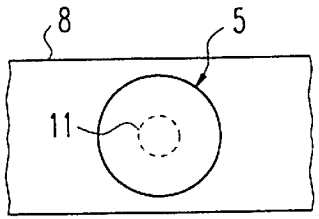
FIG. 2 is a top view of the back disc of the fastener component illustrated in FIG. 1.
Figure 3:
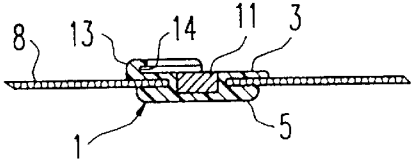
FIG. 3 is a cross section through the fastener component shown in FIGS. 1 and 2, along the line III—III in FIG. 1.
Figure 4:
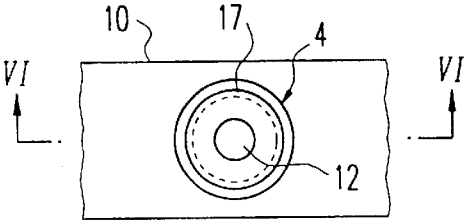
FIG. 4 is a top view of the front disc of the other, complementary fastener component in the first design example of this invention.
Figure 5:
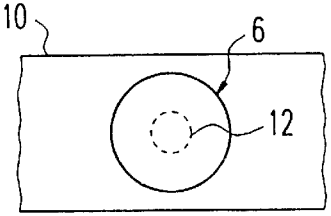
FIG. 5 is a top view of the back disc of the other, complementary fastener component shown in FIG. 4.
Figure 6:
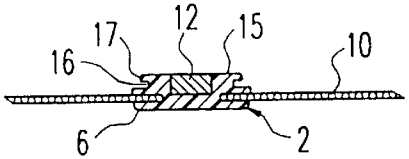
FIG. 6 is a cross section through the other, complementary fastener component shown in FIGS. 4 and 5, along the line VI—VI in FIG. 4.

The following describes the fastener according to the first design example as illustrated in FIGS. 1 to 7. The fastener according to the first design example consists of two fastener components 1 and 2 each of which is provided with a front disc 3 and 4, respectively, and with a back disc 5 and 6, respectively. The front and back discs 3, 5 of the fastener component 1 are depicted in FIGS. 1 and 2, respectively, the front and back discs 4, 6 of the other, complementary fastener component 2 are shown in FIGS. 4 and 5, respectively. The front disc 3 and the back disc 5 are firmly connected with each other by way of a smaller-diameter adapter 7 which extends through a hole in a textile strap 8. The textile strap 8 is thus sandwiched between the front disc 3 and the back disc 5 of the fastener component 1.

The front and back discs 4 and 6 of the other, complementary fastener component 2 are firmly connected with each other by way of an adapter 9 which extends through a hole in a textile strap 10. The textile strap 10 is thus sandwiched between the front disc 4 and the back disc 6 of the other, complementary fastener component 2.

The two discs of each fastener component can be connected with each other by gluing, welding, fusion or by force-fitting after the respective textile strap has been positioned between them. In the example shown, the two discs of each fastener component are bonded together by fusion.

Each fastener component 1, 2 consists of a nonmagnetic base unit and a permanent magnet 11 and 12, respectively, which is inserted and fastened, for instance by gluing, in a central pocket-type recess in the nonmagnetic base unit. The nonmagnetic base unit of each fastener component 1, 2 is an injection-molded plastic element.

Each magnet 11, 12 is positioned in the respective fastener component 1 or 2 in such fashion that one outer surface of the magnet is exposed on the top side of the front disc 3, 4 of each fastener component 1 or 2.

Figure 7:
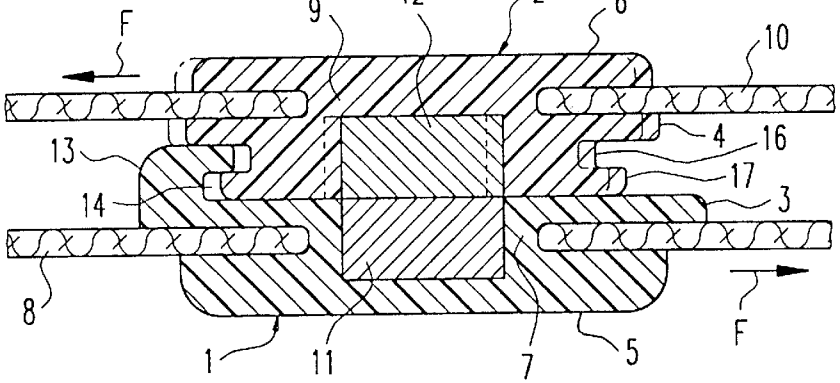
FIG. 7 is a cross section through the fastener components shown in FIGS. 1 and 2 and, respectively, FIGS. 4 and 5, with the fastener in the closed state, the cross section of each fastener component corresponding to that in FIGS. 3 and 6, and with the two fastener components illustrated on a substantially enlarged scale.

In the closed state of the fastener as illustrated in FIG. 7, the two fastener components 1, 2 are in flush contact in parallel and coaxial alignment, with the two magnets 11, 12 facing and attracting each other. Magnetic attraction can also be obtained when in lieu of one of the magnets a piece of soft iron is used.

The front disc 3 of the fastener component 1 is provided at its perimeter with a U-shaped projection 13 that has an undercut 14 inside the projection 13 facing the central axis Z of the fastener component 1. The undercut 14 gives the projection 13 the shape of a hook.

The front disc 4 of the other, complementary fastener component 2 is provided within its perimeter with a central projection 15 which has a neck 16 that transitions into a head 17 at the free end of the projection 15. The diameter of the head 17 is larger than that of the neck 16 so that it protrudes laterally from the neck 16. By virtue of the neck 16 and the head 17, the projection 15 constitutes a counterhook which, when the fastener is closed as shown in FIG. 7, engages behind the hook formed by the U-shaped projection 13. More precisely, part of the head 17 engages in the undercut 14 when the fastener is closed.

The neck 16 of the projection 15 is shaped in a way that, in the closed state, the surface of the neck 16 facing the inner edge of the projection 13 matches the inner edge of the projection 13 (sic), whereas, when the two fastener components 1, 2 are centered relative to each other, there is a gap between the inner edge of the projection 13 and the neck 16 of the projection 15, as can be seen in FIG. 7. Similarly, when the two fastener components 1, 2 are centered relative to each other, there is a gap between the inner wall delimiting the undercut and the outer edge of the disc-shaped head 17 which gap is identical to or somewhat larger than the gap between the inner edge of the projection 13 and the opposite surface of the neck 16. In the closed state shown in FIG. 7, the fastener components 1, 2 are centered relative to each other; the hook and the counterhook are only partly engaged which, however, in conjunction with the attractive force between the magnets 11 and 12, is enough to prevent the two fastener components 1, 2 from separating in the axial direction which would unlatch the fastener. In the closed state, the attraction between the two magnets 11, 12 also prevents the two fastener components 1, 2 from moving in the longitudinal direction for as long as any pulling force F acting on the straps is only minor. If and when the pulling force F is increased beyond a certain point, the fastener component 2 will shift relative to the fastener component 1 into a position as indicated by the dotted line in FIG. 7. If, in the example illustrated in FIG. 7, that force F is sufficiently large, the fastener component 2 will move far enough to the left for the two hooks to fully engage, with the inner edge of the projection 13 being in flush contact with the surface of the neck 16. When the force F is reduced by a particular amount, or to a point where the two straps 8, 10 are fully relaxed, the magnetic attraction of the magnets 11, 12 will move the two fastener components 1, 2 back into the mutually centered position.

A slight pull in the opposite direction, which in FIG. 7 means to the right for fastener component 2 and/or to the left for fastener component 1, will separate the two fastener components 1, 2 from each other; separating the fastener components 1, 2 from their centered position is particularly easy since the two hooks are only partially engaged. Closing the fastener merely requires the two fastener components 1, 2 to be brought into proximity to each other, allowing the attraction of the magnets 11, 12 to become effective which automatically brings the two fastener components into the closed state in which they are centered and the hooks are partially engaged. This self-centering action of the two fastener components makes it possible to close the fastener with one hand.

The fastener can be mass-produced in that, on one single continuous textile strip, a large number of fastener components 1 are attached at regular intervals along the length of the strip, while on a separate continuous textile strip a large number of fastener components 2 are attached at intervals corresponding to those of the components 1. These strips are then cut between neighboring fastener components, whereby individual fastener components 1 and individual fastener components 2 are produced, each with a section of the textile strip attached to it. The fastener components 1 and 2 are then paired up and each piece of textile strip is sewed to the end of the strap of the garment sections which are to be held together by the fastener.

Figure 9:
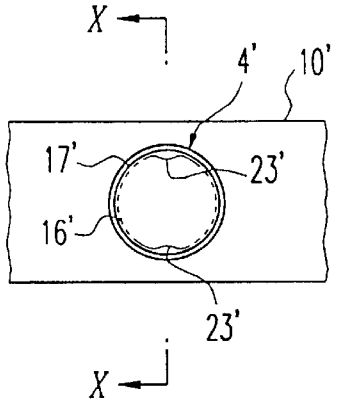
FIG. 9 is a top view of the front disc of the other, complementary fastener component in the second design example according to this invention.
Figure 8:
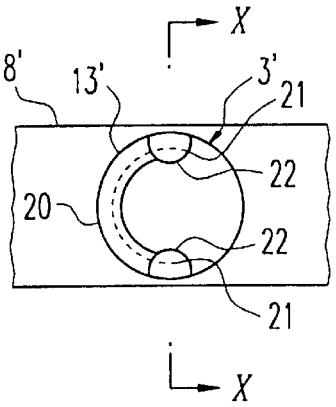
FIG. 8 is a top view of the front disc of one of the two fastener components according to a second design example of this invention.
Figure 10:
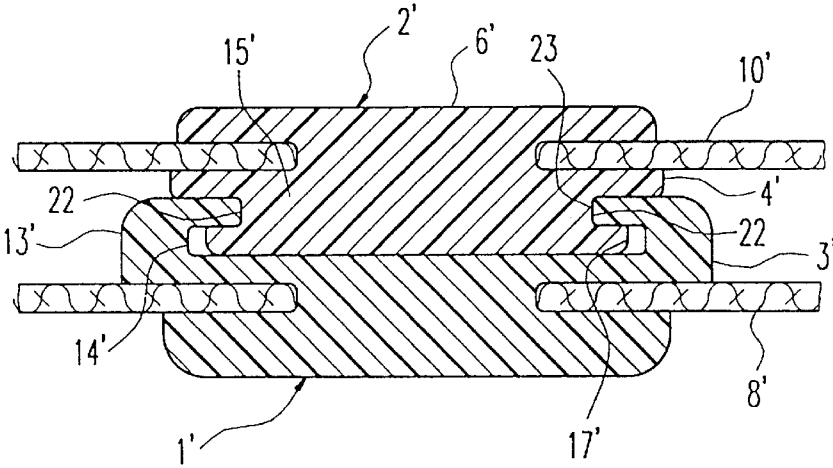
FIG. 10 is a cross section through the fastener components shown in FIGS. 8 and 9, in the closed state of the fastener according to the second design example of this invention, the cross section of each fastener component extending along the line X—X in FIG. 8 and, respectively, FIG. 9.

A second design example of this invention is illustrated in FIGS. 8, 9 and 10. In the following description of the second design example, elements which are similar in design and/or function to those in the first example bear the same reference number with the addition of an apostrophe. The second design version differs from the first design version in a few aspects which will be discussed below. The elements which in the second design example are identical to those in the first design example will be mentioned only to the extent necessary for an understanding of the difference between the two design examples.

The fastener in the second design example consists of two fastener components 1', 2' each of which is provided with a front disc 3' and 4', respectively, and a back disc 5' and 6', respectively. The two fastener components 1', 2' are attached to textile straps 8' and 10', respectively, in the same way as the fastener components 1, 2 are attached to the textile straps 8, 10 in the first design example. The front disc 3' of the fastener component 1' is provided at its perimeter with a U-shaped projection 13' which has an undercut 14' and thus forms a hook, as shown in FIG. 10. The front disc 4' of the fastener component 2' is provided inside its perimeter with a projection 15' that encompasses a neck 16' and, extending from the latter, a disc-shaped head 17'. The projection 15' of the front disc 14' of the fastener component 2' forms a counterhook which in the closed state interacts with the hook of the fastener component 1' in a manner whereby the head 17' engages in the undercut 14', as shown in FIG. 10. In contrast to the projection 13 of the first design example, the projection 13' has a center section 20 and, separated from the latter, two end sections 21 whose free ends are provided with two inward-protruding pawls 22 which are in diametrically opposite positions from each other. The neck 16' is provided with two indentations 23 which match and interact with the pawls 22. In the closed state, shown in FIG. 10, the pawls 22 of the fastener component 1' engage in the indentations 23 of the other, complementary fastener component 2'. The wall of the end section 21 of the projection 13' which supports the pawls 22 flexes in resilient fashion when the fastener component 2' is pulled out of or pushed into the fastener component 1'. In more precise terms, the surface of the neck 16' adjoining the indentations will slightly push the pawls 22 in an outward direction as the wall supporting them flexes during the process of engaging the pawls in, and disengaging them from, the indentations 23. In the closed state, the two fastener components 1', 2' are in flush, parallel, centered contact with each other, with the centering taking place by virtue of the pawls 22 snapping into the indentations 23. In this second design example, as in the first design example, a stronger pull in the closed-state direction will move the fastener component 2' out of its centered position and, relative to the fastener component 1', the fastener component 2' can be moved all the way to a point where, as in the first design example, the inner edge of the center section of the projection 13' butts against the neck 16' of the projection 15'. In this pulling process, the pawls 22 are subjected to a slight outward pressure but they remain engaged in the indentations 23. If less pull is applied or if the straps 8', 10' are completely relaxed, the elastic force exerted by the pawls 22 on the indentations 23 will push the fastener component 2' back into its centered position. To open the fastener in the second design example, the fastener component 2' is pulled in the opening direction out of the fastener component 1' up to the point where the head 17' no longer engages in the undercut 14' and the pawls 22 no longer engage in the indentations 23. The second design example does not employ any magnets. It would be possible, however, to modify the second design version so as to incorporate, as in the first design example, two permanent magnets or one permanent magnet and one magnetizable piece of metal in the fastener components 1', 2', for instance in cases where stronger axial fastening action of the fastening components is desired. It is also possible to employ a different number of pawls and indentations, or a pawl and indentation configuration that differs from the one illustrated. The fastener components 1' and 2' in the second design example are injection-molded plastic elements.

I claim:

1. A garment fastener, comprising two fastener components each of which is attached to a fabric section, each fastener component comprising:

a front disc and a back disc sandwiching the fabric section therebetween, the front disc and back disc of the respective fastener component being connected with each other through a hole in the respective fabric section, with at least one fastener component comprising a permanent magnet and the other component comprising a magnetically attractable element, wherein the front disc of one of the fastener components has a perimeter with a hook-shaped projection thereon and the front disc of the other, complementary fastener component has a perimeter with a counterhook-shaped projection thereon configured such that, in a closed state, the counterhook engages only a portion of the hook-shaped projection, and, in an off-center state, the counterhook fully engages the hook-shaped projection and the permanent magnet and magnetically attractable element, when displaced to the off-center state, urge the fastener components toward the closed state such that the front discs of the two fastener components are held resiliently in essentially flush, parallel, coaxially aligned contact with each other.

2. The garment fastener of claim 1, wherein the hook-shaped projection is U-shaped having an inside facing a central axis of the fastener component to form an undercut and the counterhook-shaped projection comprises a head which in the closed state engages in the undercut.

3. The garment fastener of claim 2, wherein the projection further comprises a neck having a circumferential surface with a portion thereof configured to complimentarily match a rearward edge of the hook-shaped projection.

4. The garment fastener of claim 3, wherein the head is essentially disc-shaped.

5. The garment fastener of claim 1, 2 or 3, wherein each fastener component further comprises a nonmagnetic base element and a permanent magnet that is firmly connected with the nonmagnetic base element, with the permanent magnets being aligned in such fashion that, in the closed state, the fastener components attract each other.

6. The garment fastener of claim 5, wherein the nonmagnetic base element is made from a synthetic plastic material and the permanent magnet is attached to the nonmagnetic base element.

7. The garment fastener of claim 5, wherein the nonmagnetic base element of each fastener component has a central recess and the permanent magnet is mounted in the central recess.

8. The garment fastener of claim 5, wherein the permanent magnets provide a pulling force to assist the counterhook-shaped projection engagement with the hook-shaped projection when in the closed state.

9. The garment fastener of claim 1, 2 or 3, wherein each fastener component comprises a nonmagnetic base element and the magnetically attractable element comprises a piece of magnetizable metal, the permanent magnet and the piece of magnetizable metal being firmly attached to the nonmetallic base element of the respective fastener components.

10. The garment fastener of claim 9, wherein the nonmagnetic base element is made from a synthetic plastic material and the permanent magnet and the piece of magnetizable metal are attached to the respective nonmagnetic base element.

11. The garment fastener of claim 10, wherein the central recess is an open pocket cavity having an open end located in the front disc of the respective fastener component.

12. The garment fastener of claim 9, wherein the nonmagnetic base element of each fastener component has a central recess and the permanent magnet and, the piece of magnetizable metal are positioned in the central recess of the nonmagnetic base element.

13. The garment fastener of claim 12, wherein the central recess is an open pocket cavity having an open end located in the front disc of the respective fastener component.

14. The garment fastener of claim 9, wherein the permanent magnet and the piece of magnetizable metal provide a pulling force to assist the counterhook-shaped projection engagement with the hook-shaped projection when in the closed state.

15. The garment fastener of claim 1, wherein each fabric section is a textile strip, with multiple fastener components attached thereto at certain intervals from one another.

16. The garment fastener of claim 15, wherein the intervals between the fastener components are identical.

17. The garment fastener of claim 1, 2 or 3, wherein the fastener components are injection-molded plastic elements.

18. A garment fastener comprising two fastener components each of which is attached to a fabric section, each fastener component comprising:

a front disc and a back disc sandwiching the fabric section therebetween, the front disc and back disc of the respective fastener component being connected with each other through a hole in the respective fabric section, wherein the front disc of one of the fastener components has a perimeter with a hook-shaped projection thereon and the front disc of the other, complementary fastener component has a perimeter with a counterhook-shaped projection thereon configured such that, in the closed state, the counterhook engages behind the hook and the front discs of the two fastener components are in essentially flush, parallel, coaxially aligned contact with each other, and further comprising at least two pawls, in essentially diametrically opposite position from each other on the inner edge of the hook-shaped projection and at least two indentations on the neck, configured to complimentarily match the pawls such that in the closed state the pawls engage in the indentations.

19. The garment fastener of claim 18, wherein the pawls extend from a wall section that flexes resiliently to permit engagement and disengagement.

* * * * *